United States Patent [19]

Difloe

[11] Patent Number: 4,914,772

[45] Date of Patent: Apr. 10, 1990

[54] DRAINABLE CUSHION AND FURNITURE SEATING

[76] Inventor: Donna M. Difloe, 1225 Lake Charles Dr., Roswell, Ga. 30075

[21] Appl. No.: 258,736

[22] Filed: Oct. 17, 1988

[51] Int. Cl.[4] ..... A47C 27/12; A47G 9/00

[52] U.S. Cl. ..... 5/461; 5/468; 5/490; 297/422; 297/452; 428/74; 428/76; 428/247

[58] Field of Search ..... 5/462, 448, 468, 434, 5/436, 490; 297/422, 445, 452; 428/74, 76, 247

[56] References Cited

U.S. PATENT DOCUMENTS

| | | | |
|---|---|---|---|
| 2,784,773 | 3/1957 | Rowland | 5/461 |
| 3,234,569 | 2/1966 | Stewart | 5/434 |
| 3,858,257 | 1/1975 | Young | 5/448 |
| 4,295,235 | 10/1981 | Deitz | 5/490 |
| 4,435,015 | 3/1984 | Trotman et al. | 5/468 |
| 4,632,459 | 12/1986 | Herschlag | 297/445 |
| 4,717,202 | 1/1988 | Batchelder, III et al. | 297/182 |
| 4,828,320 | 5/1989 | Saiger | 297/445 |

*Primary Examiner*—Alexander Grosz
*Attorney, Agent, or Firm*—Needle & Rosenberg

[57] ABSTRACT

A cushion is provided which drains liquid and dries through its bottom having an inner core of drainable filling material having a filling core and a core wrap surrounding the core, both the filling core and the core wrap having non-resinated synthetic fibers, and an outer covering surrounding the inner core. The outer covering has a top portion having air and water permeable fabric material and a bottom portion of a mesh-like material having a plurality of openings larger in size than any opening of the top portion for promoting a circulation and draining of liquid from the cushion. Furniture seating having the cushion placeable on a supporting surface having a plurality of openings therethrough is also provided.

18 Claims, 3 Drawing Sheets

DRAINABLE CUSHION AND FURNITURE SEATING

BACKGROUND OF THE INVENTION

The present invention relates to the furniture industry, and more particularly to traditional appearing upholstered furniture seating that is drainable and quick drying and well suited for outdoor, as well as indoor use.

Indoor upholstered seating, as currently known, is not designed for outdoor weather and is not easily cleanable or generally soil resistant. For this reason, outdoor seating has historically been restricted to many unupholstered surfaces. Outdoor furniture is typically made with visible plastic or metal framing, and the seating area is covered with polyester or vinyl webbing. Thin cushions or pads can be added for seating, but here too, comfort is limited, and no special drainage system is employed. The reason that regular indoor upholstered seating cannot go outdoors and survive is that conventional upholstering and framing materials, for the most part, will rapidly deteriorate. And even if the materials could survive, thicker cushioned pieces cannot totally dry within a reasonable time, and, as a result, they rot or mildew, and are damp or wet for the person using it. Another disadvantage of indoor seating is that it is normally only topically cleanable, and the cushion covers should not be removed to be cleaned. It should be recognized that outdoor seating, as we know it, is generally not an acceptable substitute for commonly recognized indoor seating.

Therefore, there exists a need for upholstered furniture seating which is drainable and dries quickly.

There exists a further need for such seating which allows for predominantly upholstered outdoor furniture which has the appearance of indoor furniture.

There exists a still further need for indoor upholstered seating which is thoroughly and easily cleanable.

SUMMARY

The present invention relates to furniture seating and cushions which drain and dry quickly.

The cushion has an inner core preferably comprised of a synthetic non-resinated fiber filler such as polyester. This material allows water to drain quickly through the cushion. The inner core may include a block-like filling core and a core wrap surrounding the filling core for providing padding and contour to the cushion. Inner core encasing means, preferably comprised of a net-like material, encases and maintains the structural integrity of the inner core, and holds the core and wrap in place when the cover is removed.

An outer covering is provided to surround the inner core. The outer covering has a fabric section which forms the seating and side portions of the cushion, as well as a part of the bottom of the cushion. The bottom of the cushion has a plurality of openings. For instance, a mesh section may be attached to the fabric section.

The result of this structure is that liquid moves with minimal impedance through and out of the cushion. Also, the structure provides for a high degree of air circulation through the cushion. Together, these features result in a drainable and quick drying cushion.

A piece of furniture seating is also provided which, particularly in conjunction with the above-described cushion, drains and dries quickly and is ideal for outdoor use.

The piece of furniture seating, such as a loveseat, sofa, ottoman, or other upholstered furniture, includes an inner framework having sloping arm rest frame members attached to vertically oriented front frame members. Water or other liquid contacting the arm rest frame members is carried rearward to the back frame members, and then down along the back frame members to the ground.

Also, synthetic batting may be placed around the frame and covered with water-resistant fabric to give the piece the appearance of traditional indoor furniture. Preferably, the batting is the same type used in the cushion so that water drains quickly to the frame, as well as directly to the ground.

Also provided is a cushion supporting surface for supporting a cushion, preferably of the type described above. A horizontally oriented rear suspension frame member is provided as is a horizontally oriented front suspension frame member. The rear suspension frame member is closer to the ground than the front suspension frame member, and a rearwardly sloping supporting surface is provided between the members. Preferably the suspension surface is comprised of criss-crossing strips of elastic or vinyl webbing material. This will provide the supporting surface with a plurality of openings when the cushion is placed on the surface. The cushion is placed on the supporting surface so that the mesh section contacts the suspension surface, and water leaving the cushion will flow unimpeded to the ground, rather than collecting on the piece of furniture. Furthermore, air circulation to the inner portions of the seating is enhanced, thereby allowing the seating to dry quickly.

DETAILED DESCRIPTION OF THE INVENTION

The present invention relates to furniture seating that can be made to resemble traditional upholstered indoor furniture seating in styling, but which can withstand the elements of nature outdoors by draining liquids, such as rain water, through a special draining system. The draining system allows liquids to quickly permeate through the seating, and also encourages air to circulate through the seating so as to facilitate drying.

Figure 1:
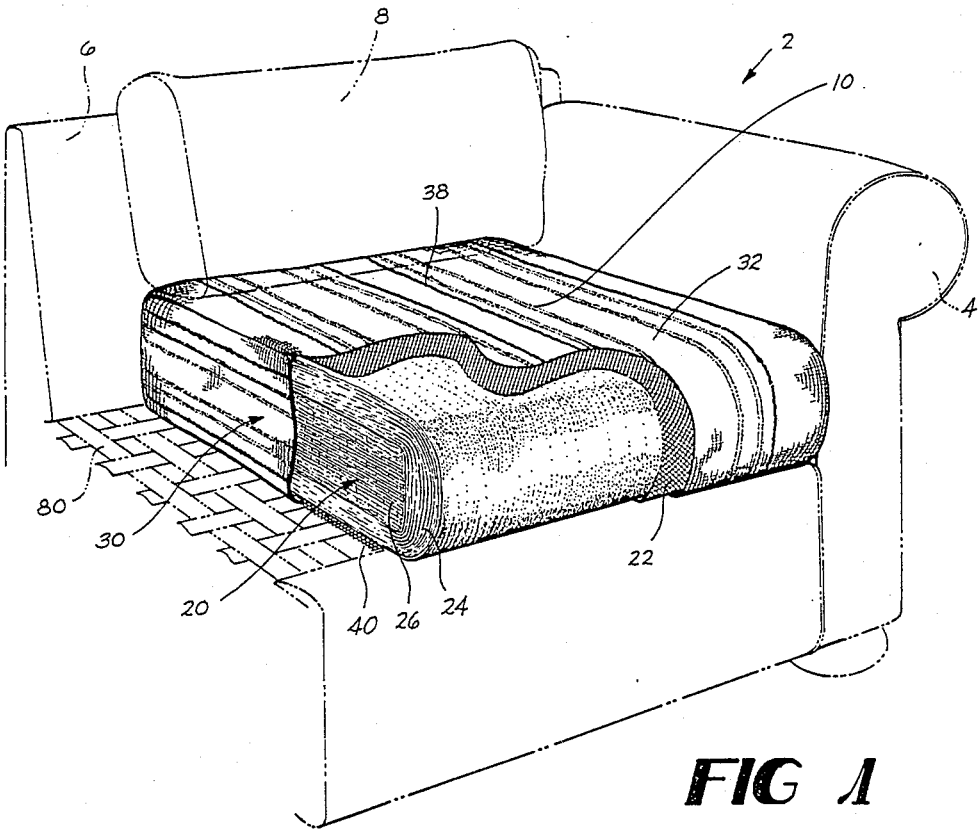
FIG. 1 is a partial cross-sectional view of furniture seating, including a cushion according to the present invention.
Figure 3:
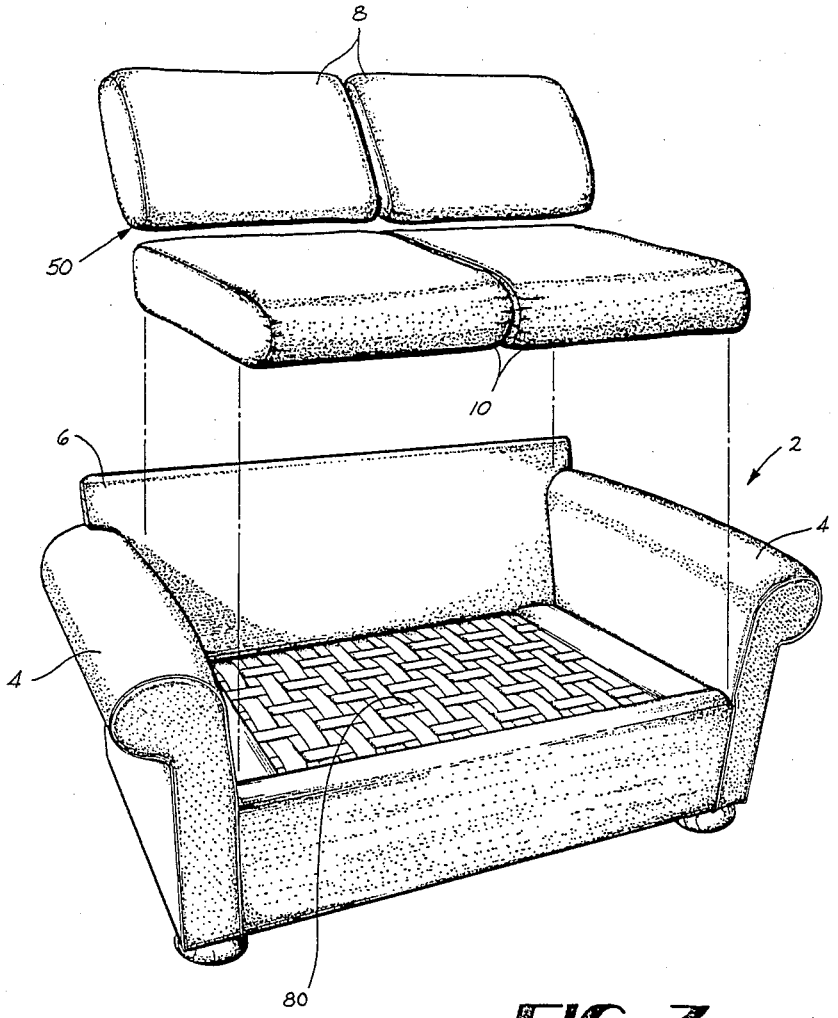
FIG. 3 is an exploded view of furniture seating according to the present invention.

FIGS. 1 and 3 illustrate a piece of furniture seating, and more particularly a loveseat 2, embodying the present invention. The loveseat 2 has a pair of arms rests 4, a back rest 6, a pair of vertically oriented, removable back cushions 8, and a pair of horizontally oriented, removable seat cushions 10.

The seat cushion 10 is designed to encourage the draining of water through its structure. As seen in FIG. 1, the cushion 10 is comprised of layers, specifically utilized to form a system which allows liquid to freely and quickly pass through the entire cushion 10 from top to bottom.

The inner core 20 of the cushion 10 is comprised of two layers of filling material which together provide the thickness, density, support and comfort of the cushion, surrounded by encasing means 22. One layer of filling or batting, used as a core wrap 24, is a fused fiber which is a non-resinated synthetic batting formed by using a unique polyester binder fiber that is blended in an intimate mix with the matrix polyester fiber. This fluffy garnetted blend (available from Wm. T. Burnett & Co., Statesville, N.C.) is an all-fiber batt securely fused at the points where its fibers touch, thereby eliminating the need for dead resinated bonding materials that can impede liquid. Since the core wrap 24 contains no resins or resin bonding, liquid is able to quickly permeate through it. Preferably, a one or two inch layer of this material is wrapped around a filling core 26, described immediately below, to provide loft, recoil, crowning, and contour to the cushion 10.

The innermost inner core layer is the filling core 26. The filling core 26 is preferably four to six inches thick, and is preferably made of synthetic non-resinated fiber batting called "densified batting", also available from Wm. T. Burnett & Co., Statesville, N.C. The density of this material allows the cushion 10 to be thick and firm, and encourages the cushion 10 to return to its original shape and loft after being sat upon. It has been found that liquid also passes quickly and freely through the filling core 26.

A core encasing layer 22 surrounds the core wrap 24 to maintain the integrity of core wrap 24 and filling core 26. Preferably, the encasing layer 22 is made of a synthetic net with up to one-half inch openings. This construction allows water to pass through the encasing layer 22 and encourages circulation to the core wrap 24 and core filling 26.

Figure 2:
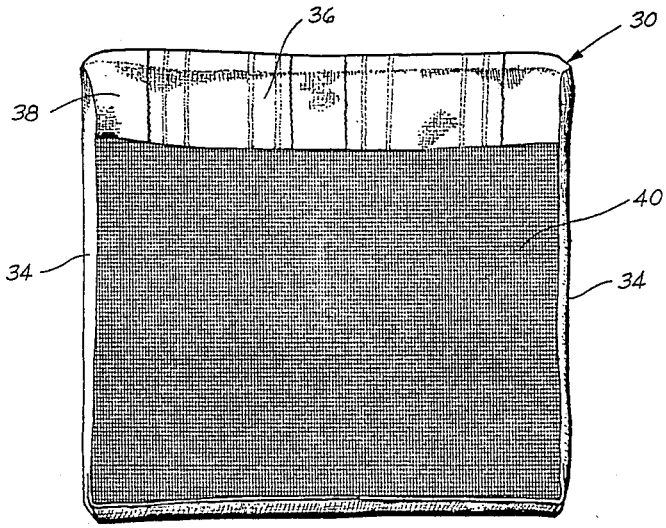
FIG. 2 is an elevational view of the bottom portion of a cushion according to the present invention.

A removable outer covering 30 is provided to encase the inner core 20, and also to promote drainage of water out of the cushion 10, as seen in FIGS. 1 and 2. The top 32, and preferably the sides 34 and a forward portion 36 of the bottom of the outer covering 30, is comprised of a decorative fabric. Preferably, the decorative fabric is made of 100% solution dyed acrylic fiber. This fiber "breathes", allowing liquid and air to readily penetrate. It is also colorful, soft, cleanable, durable, sun fade resistant, stain resistant, chemical harm resistant, and quickly dryable. It is also rot and mildew resistant. A vinyl coated polyester fabric, or a vinyl-acrylic combination fabric, or a 100% polyester fabric may also be used.

The bottom of the cushion 10 has a plurality of openings. For instance, a mesh section 40 is provided on the bottom of the outer covering 30 and is attached to the fabric section 38. Preferably, the mesh section 40 is comprised of a weather resistant mesh fabric, such as a 6 ounce vinyl dipped polyester weft, with further classification being 3.0 osy 9×9, 1000×1000 denier round weave polyester weft. The durability of the mesh and the openness of its weave allows for draining, as well as the ability for sufficient air flow towards the inner core 20. The fabric section 38 located on the bottom of the cushion aids in directing liquid to the mesh, particularly when the cushion is set on a backward incline. It also hides the mesh section 40 from view when the cushion is placed upon a furniture seat 2.

An opening may be provided on the outer covering 30 for removing the inner structure during cleaning. It is preferable that rust-proof fastening means, such as plastic fasteners or hook and loop type means, be provided for holding the opening closed.

The vertically oriented back cushion 8 may have a similar inner structure, that is, a filling core, core wrap and net-like encasement means. An outer covering is also provided, along with a mesh section 50 on its bottom surface. However, the mesh section 50 will in most cases be a narrower strip of mesh material than appears in the seat cushion 10 because the bottom of the back cushion 8 is narrow.

It should be noted, therefore, that liquid contacting and entering the back cushion 8 will quickly pass through the inner structure, unimpeded by the net-like encasing and the fillers, and be directed out through the mesh section 50. Also, the air circulation through the cushion 8 is greatly enhanced to aid in drying.

The piece of furniture seating itself also has novel features which serve to enhance and facilitate draining of liquids and drying, particularly when used in conjunction with the above-described cushions 8 and 10.

Figure 4:
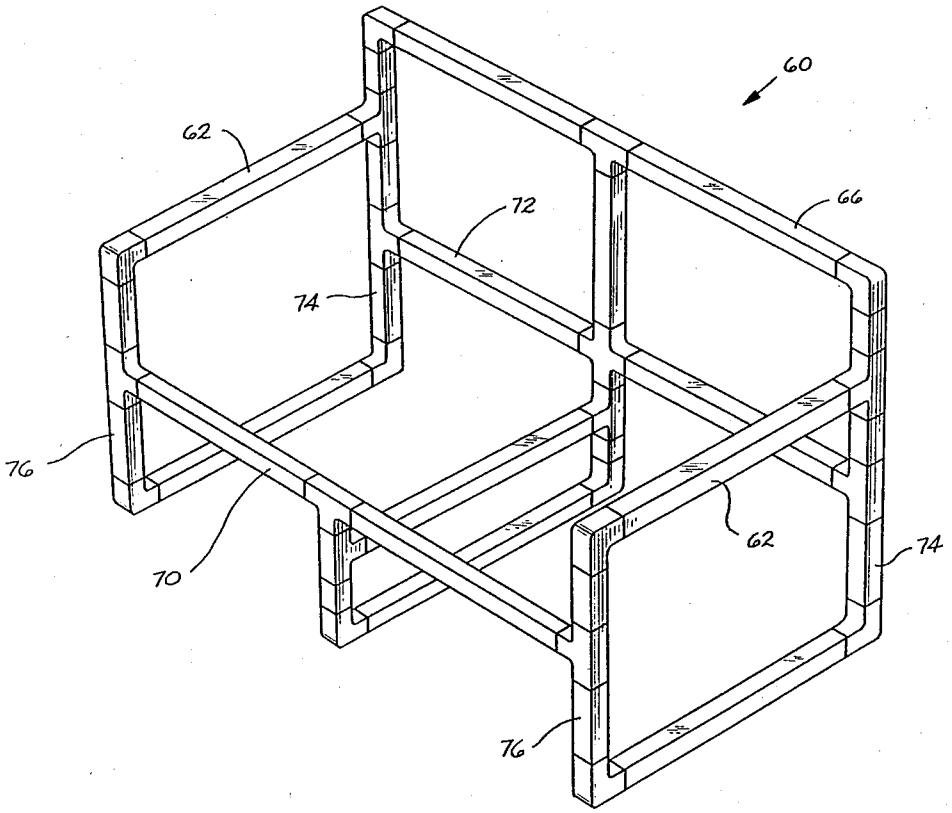
FIG. 4 is a prospective view of one embodiment of a frame used in the furniture seating of the present invention.

The frame 60, shown in FIG. 4, acts as a liquid-carrier system and may be constructed from a water resistant material, such as molded polypropylene with a co-polymer added, rigid polyvinylchloride tubing, aluminum, or marine plywood. It is important that the frame 60 does not absorb moisture, so that the movement of liquid is not impeded and travels to the ground. Any moisture that does remain is exposed to air so as to enhance the drying process. To achieve such properties, the frame 60 is constructed to eliminate collection of water atop the individual frames members. To achieve this, typically horizontal frame members are sloped downward to enhance run-off of water. For example, the arm rest frame members 62 are sloped slightly downward toward the back of the frame 60, so that any liquid contacting the arm rest frame member 62 is carried forward toward the rear frame members 74. Gravity will then carry the water downward along the rear frame members 74. Similarly, the rear upper frame member 66 may be sloped downwardly towards their outer ends, as may be the front and rear suspension frame members 70 and 72.

Also, the frame 60 is constructed to provide a rearwardly pitched cushion supporting surface 80. A horizontally oriented rear suspension frame member 72 is provided, held in position by a pair of vertically oriented rear frame members 74. A horizontally oriented front suspension frame member 70 is held between the front frame members 76. The front suspension surface frame member 70 is held between front frame members 76. The front suspension surface frame member 70 is slightly higher than the rear suspension frame member 72, so that a suspension surface positioned between the two suspension frame members 70 and 72, as discussed more fully below, is angled backward.

Referring to FIGS. 1 and 3, a cushion supporting surface is provided for supporting a seat cushion 10. The surface 80 has openings for facilitating the draining of water leaving the seat cushion 10. For example, the supporting surface 80 may be made from criss-crossing strips of webbing material. A series of springs, preferably comprised of water-resistant material, may also be used to form the supporting surface 80. Therefore, when the cushion 10 is placed on the seating so that the mesh section 40 contacts the supporting surface 80, water will drain through the mesh and openings in the surface 80 with little resistance. Also, the openings of the supporting surface 80 facilitate air circulation to the cushion 10. The backward pitch of the supporting surface 80 in combination with the bottom fabric section 38 of the cushion 10 directs water to the cushion mesh section 40, thereby enhancing drainage from the cushion 10. The pitch also makes the furniture seating more comfortable to sit on.

The piece of furniture seating also uses synthetic batting to pad and contour the arm rests, backrest, and other vertical surfaces. It is preferred that the batting used for such purposes be the non-resinated synthetic fiber used in the seat cushion 10. This will provide for enhanced air circulation through the furniture seating and will encourage draining of liquid to the frame carrier system as well as directly to the ground.

Additional alterations have to be made to produce a piece of furniture which fully takes advantage of the present invention.

The legs should be made from molded plastic (preferably high impact polystyrene), and either wrapped with the decorative fabric or primed and then painted with a polyurethane high solids top coat for extra protection and wear for the polystyrene. Another form of polystyrene, sheet polystyrene, in 0.40 thickness, may be used for stiffeners in place of the cardboard that is conventionally used in indoor seating. These stiffeners provide sewable surfaces for attaching padding and fabric. Still another synthetic part, PVC edgebanding, may be used as a substitute for the conventional paper fiber tack strip. Silicone glue and PVC glue should be used wherever there is a need for glue; and a special high heat resistant glue may be used for attaching welting. Almost all the aforementioned materials are synthetics, and will bear up under varying harsh conditions. Fasteners, such as staples, screws, T-nuts, and hanger bolts, should be either stainless steel, brass, or a plated metal which will inhibit rusting from moisture, chemicals, salt sprays, etc. A plastic mesh dust barrier may be provided on the bottom of the frame 60. Other considerations include not using any welting on the cushions to block liquid, pointing all pleats downward, not using complex stump panels, keeping style choices basic, and not using any commonly used decorative treatments that would trap liquid. Also, the fabric and batting should be attached in a manner which doesn't impede the flow of liquid.

It should be apparent that the furniture seating of present invention has many advantages over traditional furniture. It is drainable and has enhanced air circulation. Therefore, it dries very rapidly and is ideal for outdoor use. However, it has the traditional appearance of indoor furniture, and also can be very practical for indoor use. The improved cushions may be thick and comfortable, yet still usable outdoors.

Also, because it is drainable and dryable, the entire piece of furniture may be cleaned using normal household cleaning agents, thereby eliminating the need for using professional upholstery cleaners. This is particularly advantageous when the furniture is used outdoors, or in other situations where soiling and staining is a problem.

While the above description contains many specificities, these should not be construed as limitations on the scope of the invention, but rather as an amplification of one preferred embodiment thereof. For example, other pieces of furniture incorporating the principles set forth herein are envisioned. Also, the cushions 8 and 10 may be used in applications other than in conjunction with the piece of furniture described herein. For instance, the cushions 8 and 10 may be used on boats, or anywhere else a drainable quick drying cushion is desired.

What is claimed is:

1. A cushion which drains liquid and dries through its bottom, comprising:

(a) an inner core of drainable filling material comprising a filling core and a core wrap surrounding said core, both said filling core and said core wrap comprising non-resinated synthetic fibers; and (b) an outer covering surrounding said inner core, said outer covering comprising:

(i) a top portion comprising air and water permeable fabric material and (ii) a bottom portion of a mesh-like material having a plurality of openings larger in size than any opening of said top portion for promoting air circulation and draining of liquid from said cushion.

2. The cushion of claim 1, wherein said bottom portion having a plurality of openings is comprised of a mesh section.

3. The cushion of claim 2, wherein a portion of said fabric section is connected to said mesh section at said bottom portion of said cushion for directing liquid to said mesh section.

4. The cushion of claim 1, wherein said outer covering has an opening through which said inner core may be removed, and means for sealing said opening.

5. The cushion of claim 1, wherein said film core is comprised of non-resinated polyester fibers.

6. The cushion of claim 1, wherein said core wrap is comprised of non-resinated polyester fibers.

7. The cushion of claim 1, wherein said filling material is surrounded by encasing means, said encasing means comprised of a net-like material.

8. Furniture seating comprising;

(a) a frame having a cushion supporting surface for supporting a cushion, said surface having a plurality of openings therethrough; and (b) a removable cushion which drains and dries through its bottom, said cushion comprising;

(i) an inner core of drainable filling material comprising a filling core and a core wrap surrounding said core, both said filling core and said core wrap comprising non-resinated synthetic fibers; and (ii) a top portion comprising air and water permeable fabric material and a bottom portion of mesh-like material having a plurality of openings larger in size than any opening of said top portion, said bottom portion of said cushion corresponding to said cushion supporting surface when said cushion is placed on said furniture to facilitate draining of fluid and drying of said filling material through said furniture.

9. The furniture seating of claim 8, whereby said bottom portion having a plurality of openings is comprised of a mesh portion.

10. The furniture seating of claim 8, and further comprising drainable batting material surrounding said frame and fabric forming an outer covering for said frame and batting material.

11. The furniture seating of claim 10, wherein said frame comprises sloped frame members.

12. The furniture seating of claim 9, wherein said fabric section is connected to said mesh section at said bottom portion of said cushion for directing liquid to said mesh section.

13. The furniture seating of claim 8, wherein said outer covering has an opening through which said inner core may be removed, and means for sealing said opening.

14. The furniture seating of claim 8, wherein said filling material is non-resinated polyester fibers.

15. The furniture seating of claim 8, wherein said cushion is removable from said supporting surface.

16. The furniture seating of claim 8, wherein said cushion is attached to said supporting surface.

17. The furniture seating of claim 8, wherein said supporting surface comprises criss-crossing strips of webbing material.

18. The furniture seating of claim 8, wherein said filling material is surrounded by encasing means, said encasing means comprised of a net-like material.

* * * * *